US010036215B2

(12) United States Patent
Wood

(10) Patent No.: US 10,036,215 B2
(45) Date of Patent: Jul. 31, 2018

(54) SWIVEL ELEVATOR

(71) Applicant: Weatherford Technology Holdings, LLC, Houston, TX (US)

(72) Inventor: Kevin Wood, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 455 days.

(21) Appl. No.: 14/229,372

(22) Filed: Mar. 28, 2014

(65) Prior Publication Data

US 2015/0275592 A1 Oct. 1, 2015

(51) Int. Cl.
*E21B 19/07* (2006.01)
*E21B 19/16* (2006.01)

(52) U.S. Cl.
CPC ..... *E21B 19/07* (2013.01); *E21B 19/16* (2013.01)

(58) Field of Classification Search
CPC combination set(s) only.
See application file for complete search history.

(56) References Cited

U.S. PATENT DOCUMENTS 3,434,696 A * 3/1969 Brackin ..... B66C 1/34 254/401
3,722,603 A 3/1973 Brown
3,760,469 A * 9/1973 Brown ..... E21B 19/07 279/4.06
3,915,244 A * 10/1975 Brown ..... E21B 19/20 166/77.52
5,349,894 A * 9/1994 Greer ..... F15B 15/26 91/392
6,994,176 B2 * 2/2006 Shahin ..... E21B 7/20 166/77.52
7,191,840 B2 3/2007 Pietras et al.
7,281,587 B2 10/2007 Haugen
7,793,719 B2 9/2010 Snider et al.
8,325,610 B2 12/2012 Fischer
2004/0016575 A1 * 1/2004 Shahin ..... E21B 3/04 175/423

(Continued)

FOREIGN PATENT DOCUMENTS

EP 1726774 A2 11/2006
WO 0052297 A2 9/2000
WO 2012040469 A2 3/2012

OTHER PUBLICATIONS

EPO Extended European Search Report dated Sep. 10, 2015, for European Patent Application No. 15160208.3.

(Continued)

*Primary Examiner* — David J Bagnell
*Assistant Examiner* — Ronald R Runyan
(74) *Attorney, Agent, or Firm* — Patterson & Sheridan, LLP

(57) ABSTRACT

A method and apparatus for attaching tubulars to a tubular string in a well bore. The apparatus includes a drill rig elevator configured with a rotatable set of slips that grip the tubular to be added to the tubular string. As a result, the elevator can grip the tubular to pick up and position the tubular and can continue to grip the tubular as the tubular is spun to be threaded onto the tubular string in the well bore. The slips can also be moved axially to compensate for movement of the tubular toward the tubular string as the tubular threadingly attaches to the tubular string.

32 Claims, 17 Drawing Sheets

(56) References Cited

U.S. PATENT DOCUMENTS

2005/0000691 A1* 1/2005 Giroux ..... E21B 7/20
166/291

OTHER PUBLICATIONS

Australian Patent Examination Report dated Nov. 18, 2015, for Australian Application No. 2015201488.
Canadian Office Action dated Jan. 29, 2016, for Canadian Patent Application No. 2,885,335.
EPO Examination Report dated Jan. 3, 2017, for EPO Patent Application No. 15160208.3.
Canadian Office Action dated Jan. 18, 2017, for Canadian Patent Application No. 2,885,335.

* cited by examiner

SWIVEL ELEVATOR

BACKGROUND OF THE INVENTION

Field of the Invention

Embodiments of the present invention generally relate to apparatus and methods for facilitating the connection of tubulars of a drilling rig.

Description of the Related Art

In the construction and completion of oil or gas wells, a drilling rig is constructed on the earth's surface to facilitate the insertion and removal of tubular strings into a wellbore. The drilling rig includes a platform and power tools such as an elevator and a spider to engage, assemble, and lower the tubulars into the wellbore. The elevator is suspended above the platform by a draw works that can raise or lower the elevator in relation to the floor of the rig. The spider is mounted in the platform floor. The elevator and spider both have slips that are capable of engaging and releasing a tubular, and are designed to work in tandem. Generally, the spider holds a tubular or tubular string that extends into the wellbore from the platform. Traditionally, the elevator engages a new tubular and aligns it over the tubular string being held by the spider. A power tong and a spinner are then used to thread the upper and lower tubulars together. Once the tubulars are joined, the spider disengages the tubular string and the elevator lowers the tubular string through the spider until the elevator and spider are at a predetermined distance from each other. The spider then re-engages the tubular string and the elevator disengages the string and repeats the process. This sequence applies to assembling tubulars for the purpose of drilling a wellbore, running casing to line the wellbore, or running wellbore components into the well. The sequence can be reversed to disassemble the tubular string.

During the drilling of a wellbore, a drill string is made up and is then necessarily rotated in order to drill. Historically, a drilling platform includes a rotary table and a gear to turn the table. In operation, the drill string is lowered by an elevator into the rotary table and held in place by a spider. A Kelly is then threaded to the string and the rotary table is rotated, causing the Kelly and the drill string to rotate. After thirty feet or so of drilling, the Kelly and a section of the string are lifted out of the wellbore and additional drill string is added.

The process of drilling with a Kelly is expensive due to the amount of time required to remove the Kelly, add drill string, reengage the Kelly, and rotate the drill string. In order to address these problems, top drives were developed.

For example, FIG. 1 shows a drilling rig 100 configured to connect and run casings into a newly formed wellbore 180 to line the walls thereof. As shown, the rig 100 includes a top drive 200, an elevator 120, and a spider 400. The rig 100 is built at the surface 170 of the well. The rig 100 includes a traveling block 110 that is suspended by wires 150 from draw works 105 and holds the top drive 200. The top drive 200 has a gripping tool 301 for engaging the inner wall of the casing 130 and a motor 240 to rotate the casing 130. The motor 240 may rotate and thread the casing 130 into the casing string 130 held by the spider 400. The gripping tool 301 facilitates the engagement and disengagement of the casing 130 without having to thread and unthread the casing 130 to the top drive 200. Additionally, the top drive 200 is coupled to a railing system 140. The railing system 140 prevents the top drive 200 from rotational movement during rotation of the casing string 130, but allows for vertical movement of the top drive 200 under the traveling block 110.

In FIG. 1, the gripping tool 301 is shown engaged to casing 130. The casing 130 is placed in position below the top drive 200 by the elevator 120 in order for the gripping tool 301 to engage the casing 130. Additionally, the spider 400, disposed on the platform 160, is shown engaged around a casing string 130 that extends into wellbore 180. Once the casing 130 is positioned above the casing string 130, the top drive 200 can lower and thread the casing 130 into the casing string 130 in the wellbore, thereby extending the length of the casing string 130. Thereafter, the extended casing string 130 may be lowered into the wellbore 180.

FIG. 1 illustrates a drilling rig 100 that lifts and installs individual casing sections 130'. FIG. 2 illustrates a drilling rig 100' that lift three casing sections 130' that have been pre-coupled. FIG. 2 illustrates a first set of three joined casing sections 130' attached to the top drive 200 and positioned above the casing string 130 in the spider 400. FIG. 2 also illustrates two additional sets of three joined casing sections 130' positioned for lifting by the elevator 120 (described below).

FIG. 3 illustrates the gripping tool 301 engaged to the casing string 130 after the casing string 130 has been lowered through a spider 400. The spider 400 is shown disposed on the platform 160. The spider 400 comprises a slip assembly 440 including a set of slips 410 and piston 420. The slips 410 are wedge-shaped and constructed and arranged to slidably move along a sloped inner wall of the slip assembly 440. The slips 410 are raised or lowered by the piston 420. When the slips 410 are in the lowered position, they close around the outer surface of the casing string 130. The weight of the casing string 130 and the resulting friction between the casing string 130 and the slips 410 force the slips downward and radially inward, thereby tightening the grip of the slips 410 on the casing string 130. When the slips 410 are in the raised position as shown, the slips 410 are opened and the casing string 130 is free to move axially relative to the slips 410.

The above-described method of connecting tubulars is complicated and time-consuming, requiring the elevator 120 and gripping tool 301 to alternately grip and release the tubulars in a particular sequence. Thus, there is a need for an apparatus and method that simplifies the connection of tubulars.

SUMMARY OF THE INVENTION

Embodiments of the present invention generally relate to an elevator for use in positioning tubulars on a drilling rig. More specifically, embodiments of the elevator can grip and position a tubular above a tubular string in a wellbore, and a portion of the elevator can rotate with the tubular so that the elevator can continue to grip and support the tubular as the tubular is threaded onto the tubular string in the wellbore.

Embodiments of an elevator can include a housing that is configured to be coupled to (e.g., suspended from) bails of a drilling rig. The elevator can also include an inner body, a portion of which rotates about an axis relative to the housing. A plurality of slips can be arranged relative to the inner body. The slips rotate about the axis with the inner body and also move relative to the inner body along the axis between a first slip position and a second slip position. In the first slip position, the slips can grip a tubular. In the second position, the slips can release the tubular. The elevator can also include a coupling between the inner body and the housing that enables the inner body to move axially, rotationally, or both, relative to the outer body along the axis as a tubular gripped by the slips is threaded onto a tubular string.

Various embodiments of an elevator can include a housing that includes two ears configured to receive bails attached to the drilling rig. The housing can define a first circular aperture therethrough and the circular aperture can define an axis of rotation. The elevator can also include an outer body that defines a second circular aperture therethrough, wherein the second aperture is coaxial with the first aperture. The outer body can move along the axis of rotation relative to the housing. The elevator can also include an inner body that defines a third circular aperture therethrough, wherein the third circular aperture is coaxial with the first circular aperture and the second circular aperture. The inner body can also move along the axis with the outer body and rotate about the axis relative to the outer body. The elevator can also include a plurality of slips arranged within the third aperture, wherein the slips are configured to rotate about the axis with the inner body. The slips can also move from a first position within the third aperture to a second position along the axis to grip a tubular passing through the first, second and third circular apertures. Rotation of the inner body and plurality of slips about the axis of rotation can spin a gripped tubular into threading engagement with each tubular string to wellbore. As the tubular is spun into threading engagement with the tubular string, the outer body and inner body can move along the axis to compensate for motion of the tubular toward the tubular string.

Various embodiments include a method for adding a tubular to a tubular string. The method includes positioning a drill rig elevator over a top end of the tubular and then moving slips disposed in the elevator to grip the top end of the tubular. After the top end of the tubular is gripped the elevator can be raised to raise the tubular over a drill rig spider, wherein the drill rig spider holds a top end portion of a tubular string in a wellbore. While the slips disposed in the elevator gripped the tubular, the tubular can be rotated to threadingly attach a bottom end of the tubular with a top end of the tubular string, and simultaneously move a portion of the elevator gripping tubular downward toward the spider. After the tubular is attached to the tubular string, the spider can release the tubular string such that the tubular and the attached tubular string are suspended from the elevator. The elevator can then be lowered to lower the tubular string in tubular into the wellbore. After the elevator has been lowered, the spider can re-grip the tubular string near the top end of the tubular that was just attached. The slips in the elevator can then be released to release the tubular string in tubular.

In one embodiment, a drilling rig elevator for handling a tubular includes a housing having a first aperture therethrough for accommodating the tubular; an outer body having a second aperture therethrough and at least partially disposed in the housing; an inner body having a third aperture therethrough and at least partially disposed in the outer body, wherein the third aperture is coaxial with the first aperture and the second aperture; and a plurality of slips arranged within the third aperture and configured to grip the tubular passing through the first, second, and third apertures.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
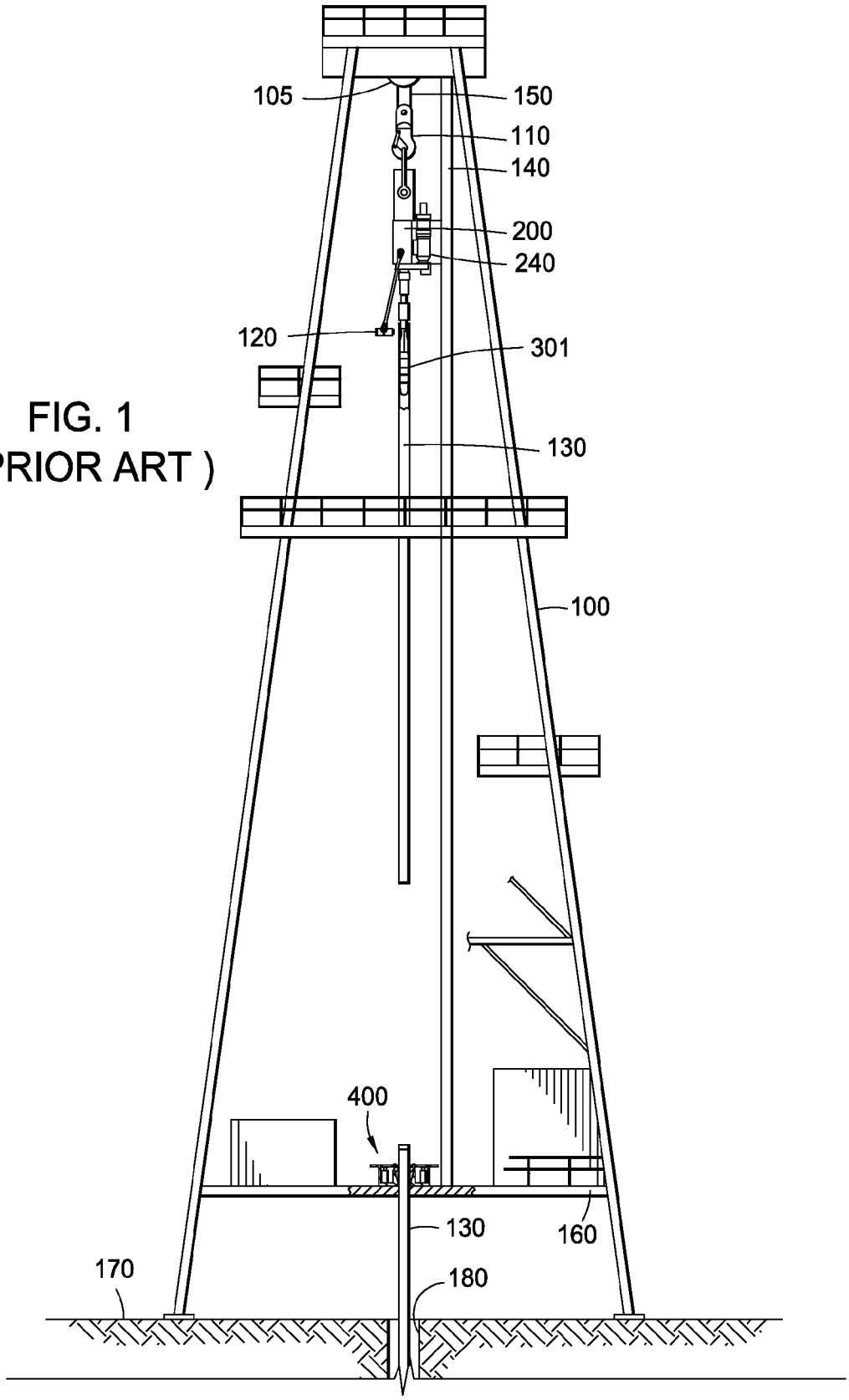
FIG. 1 ( PRIOR ART )
FIGS. 1 and 2 show a rig having a top drive and an elevator configured to connect tubulars.

Embodiments of the present invention include an elevator that includes gripping elements that can rotate with a gripped tubular that is being spun by a top drive. Furthermore, embodiments of the present invention can include a compensation system that axially moves a portion of the elevator that includes the gripping elements downward toward the wellbore with the tubular as the tubular is threaded onto a tubular string in the wellbore.

Referring to FIGS. 4A-4C, 5A-5C, and 6A-6C, embodiments of a swivel elevator 500 can include a housing 502 with ears 504 extending therefrom. As described in greater detail below, the housing 502 of the elevator 500 supports a non-rotating outer body 506 that can be raised and lowered relative to the housing 502 to compensate for a tubular moving axially as it is threaded onto a tubular string held in a spider (e.g., spider 400). The housing 502 and the outer body 506 in turn support a rotatable inner body 508, rotatable slips 518, and actuators for moving the slips 518.

Figure 3:
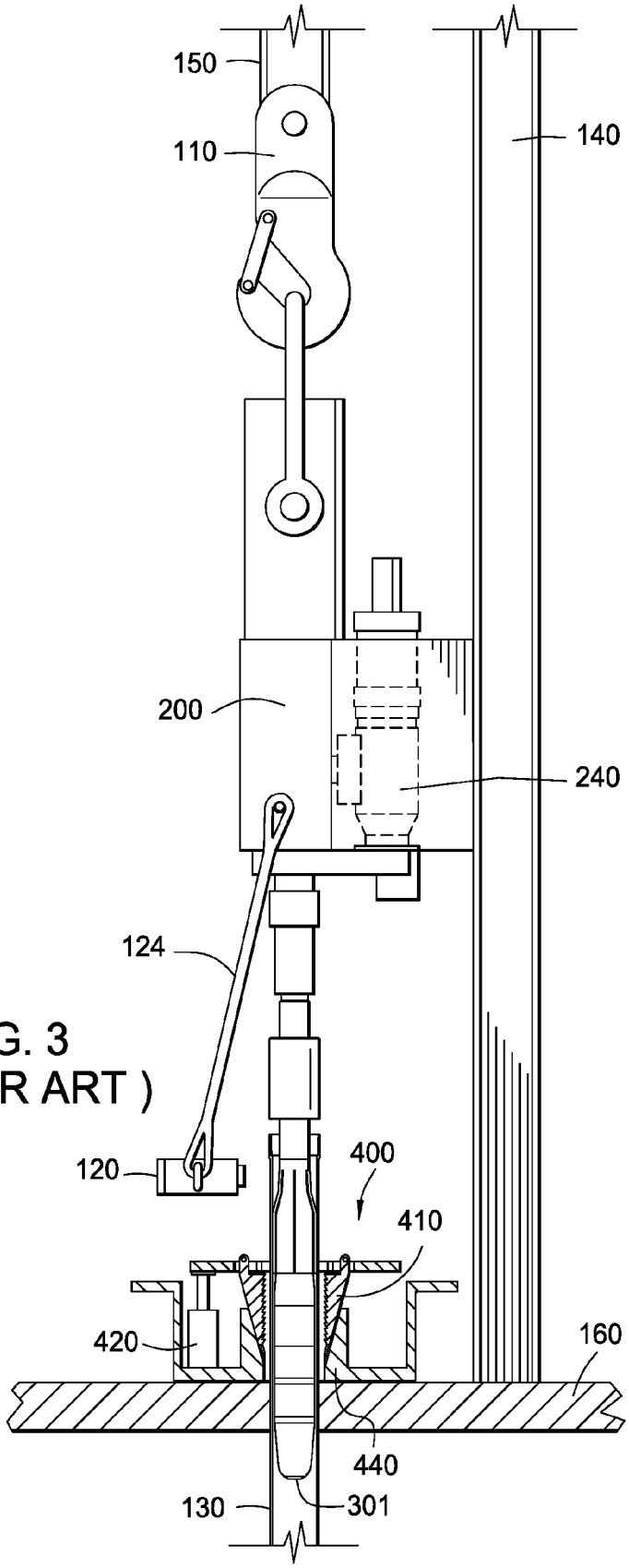
FIG. 3 ( PRIOR ART )
FIG. 3 illustrates the top drive engaged to a tubular that has been lowered through a spider.

In various embodiments, the housing 502 can be suspended on a drilling rig by bales (e.g., bales 124 shown in FIG. 3). The housing 502 defines an aperture 536 on a bottom side through which a tubular such as a casing can be inserted. In various embodiments, the aperture 536 is circular and centered about an axis of rotation 538. The housing 502 also defines a cavity 503. An outer body 506 can be nested in the cavity 503 of the housing 502 and connected to the housing 502 by actuators 534 (e.g., hydraulic or pneumatic pistons). The actuators 534 are configured to move the outer body 506 axially relative to the housing 502. As shown in FIGS. 4A-4C and 6A-6C, when the actuators 534 are in a retracted position, the outer body 506 can be positioned in the cavity 503 of the housing 502. As shown in FIGS. 5A-5C, when the actuators 534 are in an extended position, the outer body 506 can move out of the cavity 503 in a direction along the axis of rotation 538. When a tubular gripped by the elevator 500 is threaded onto a tubular string held by a spider (e.g., spider 400), the gripped tubular will be pulled downwardly toward the spider. As described in greater detail below, the actuators 534 can start in an extended position and, as the tubular is threaded onto the tubular string, the actuators 534 can gradually move toward the retracted position to move the inner body 508 and slips 518 along with the tubular.

Figure 4A:
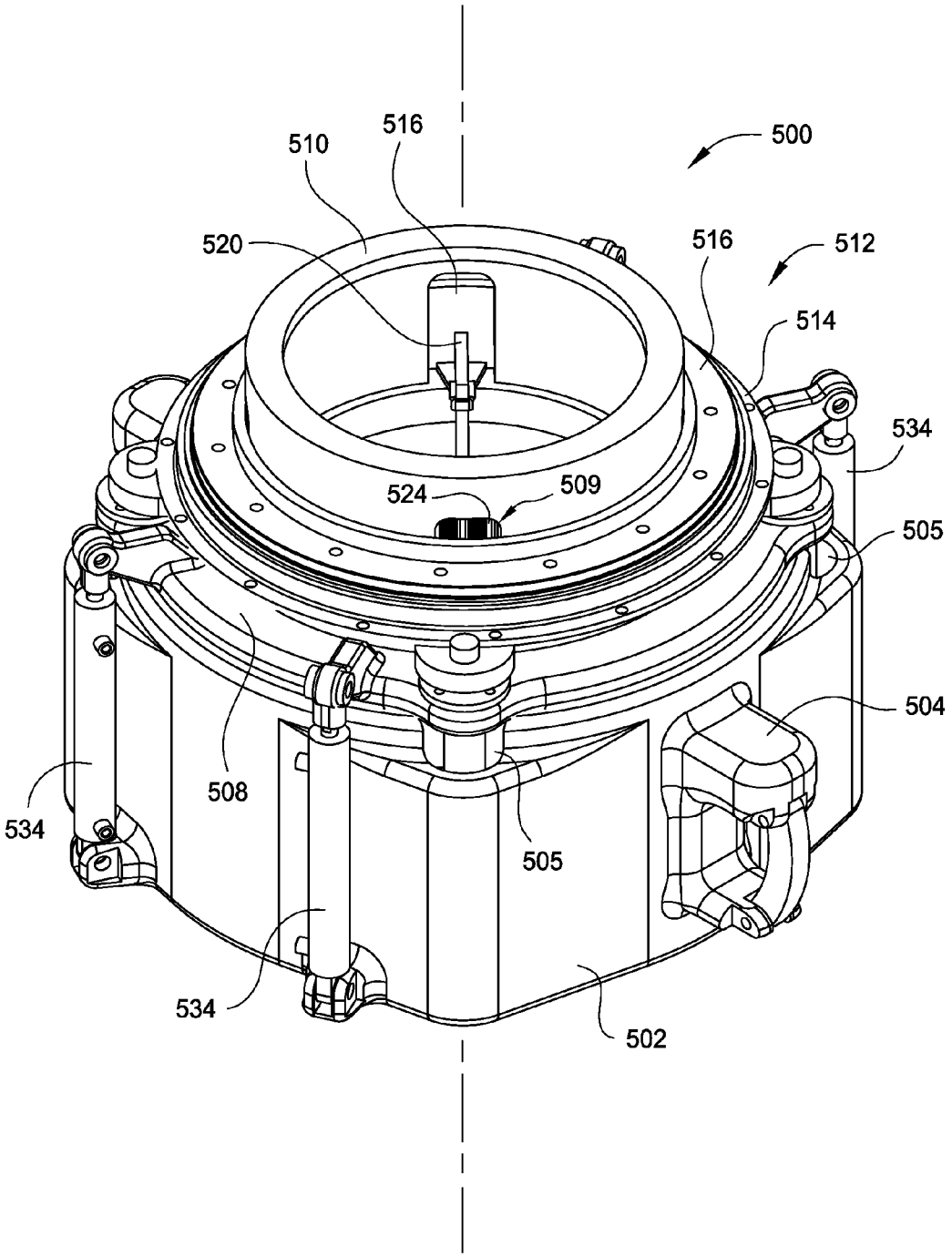
FIG. 4A is a perspective view of an embodiment of a swivel elevator arranged with a compensation system and a leveling ring both in a lowered position.
Figure 4B:
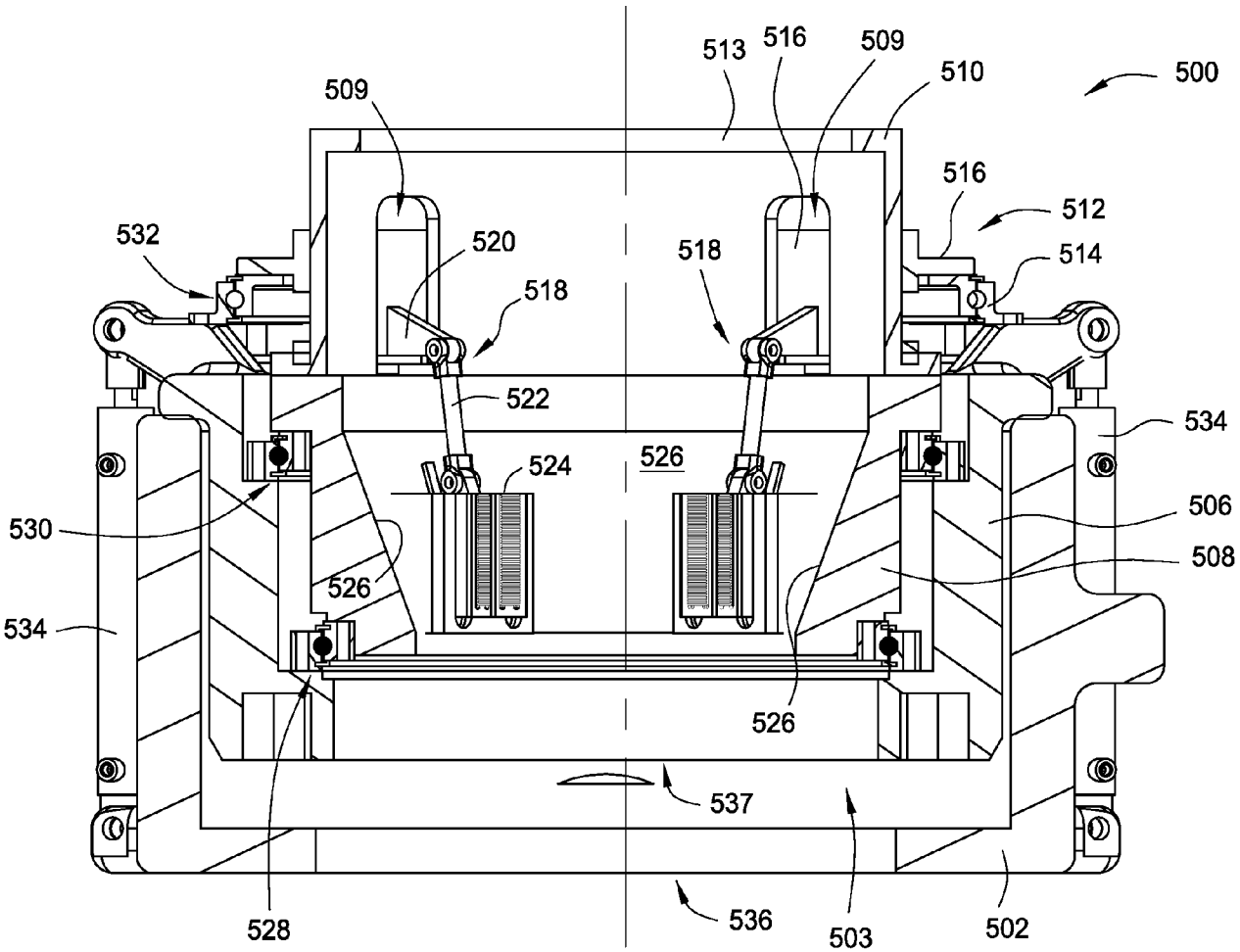
FIG. 4B is a first cross-sectional view of the swivel elevator of FIG. 4A.
Figure 4C:
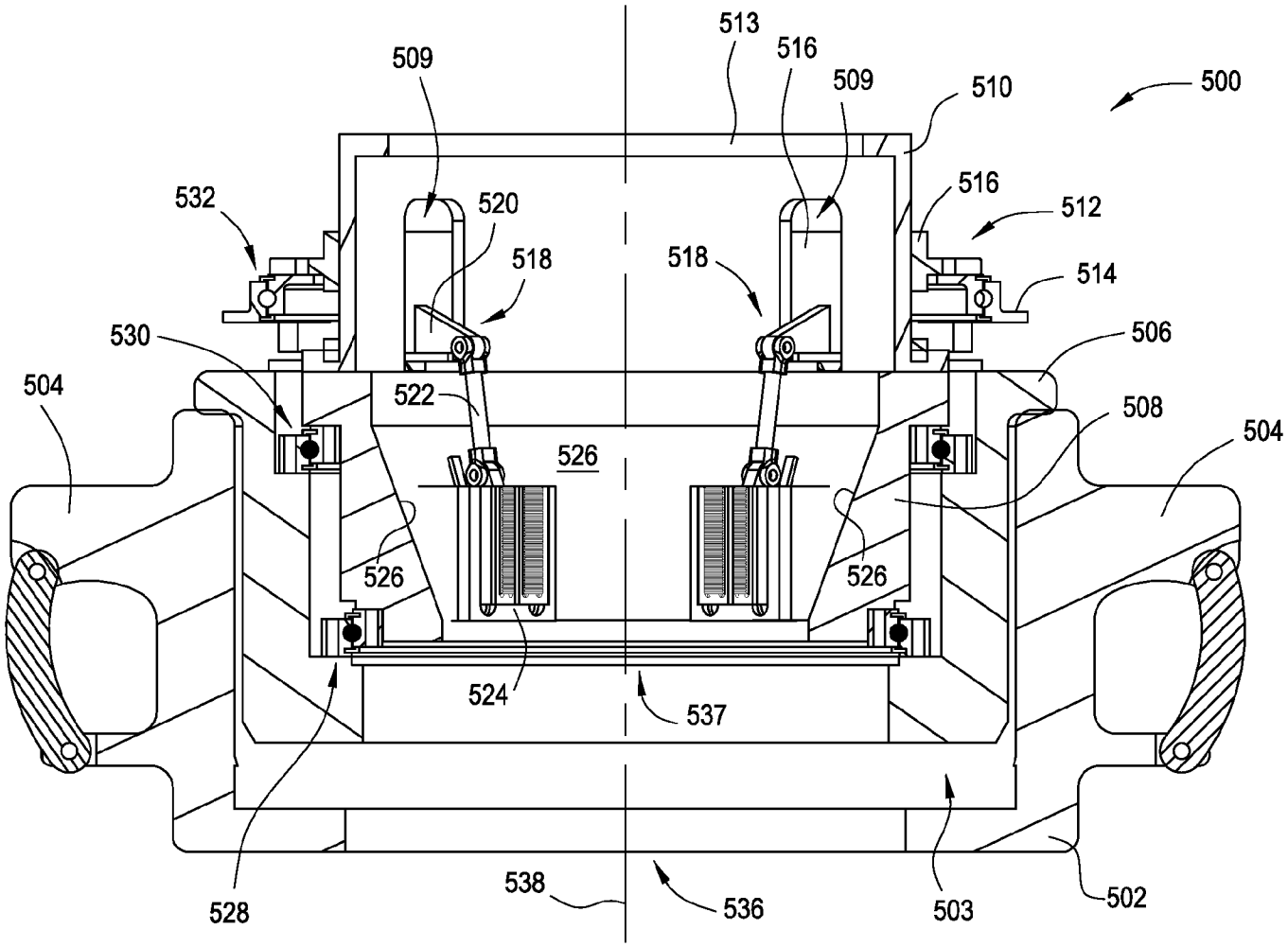
FIG. 4C is a second cross-sectional view of the swivel elevator of FIG. 4A of the swivel elevator.
Figure 5A:
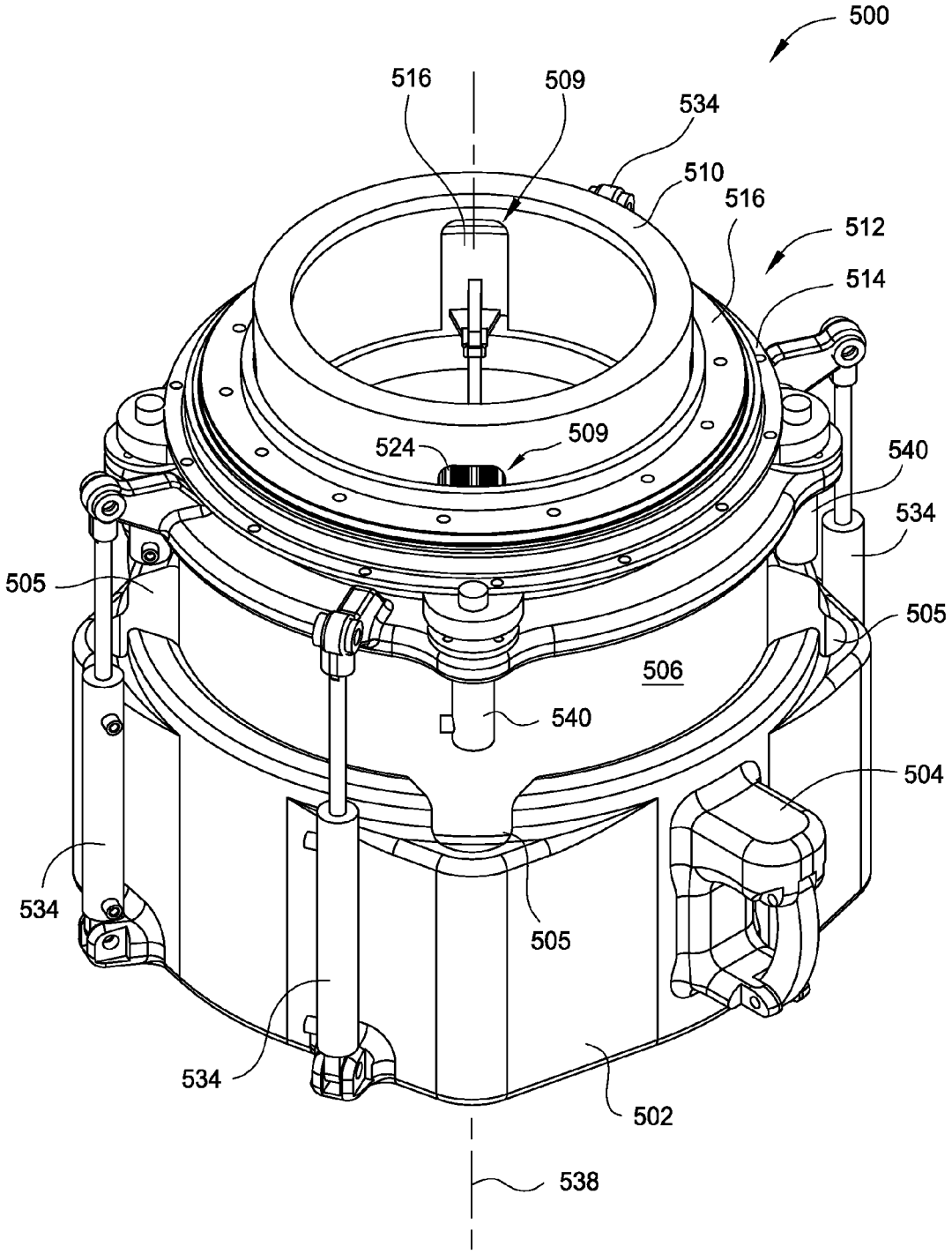
FIG. 5A is a perspective view of the swivel elevator of FIG. 4A arranged with the compensation system in a raised position and the leveling ring in the lowered position.
Figure 5B:
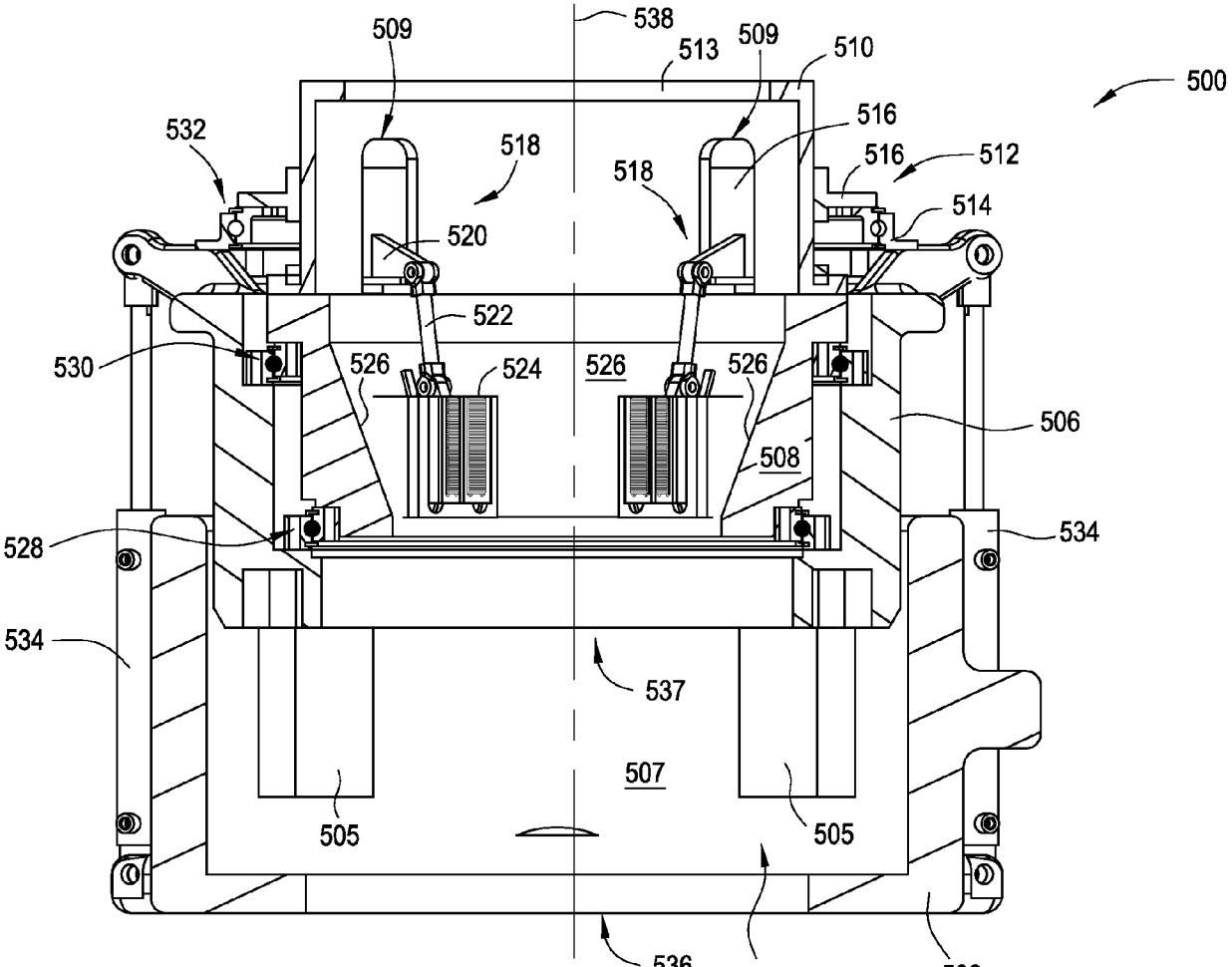
FIG. 5B is a first cross-sectional view of the swivel elevator of FIG. 4A as arranged in FIG. 5A.
Figure 5C:
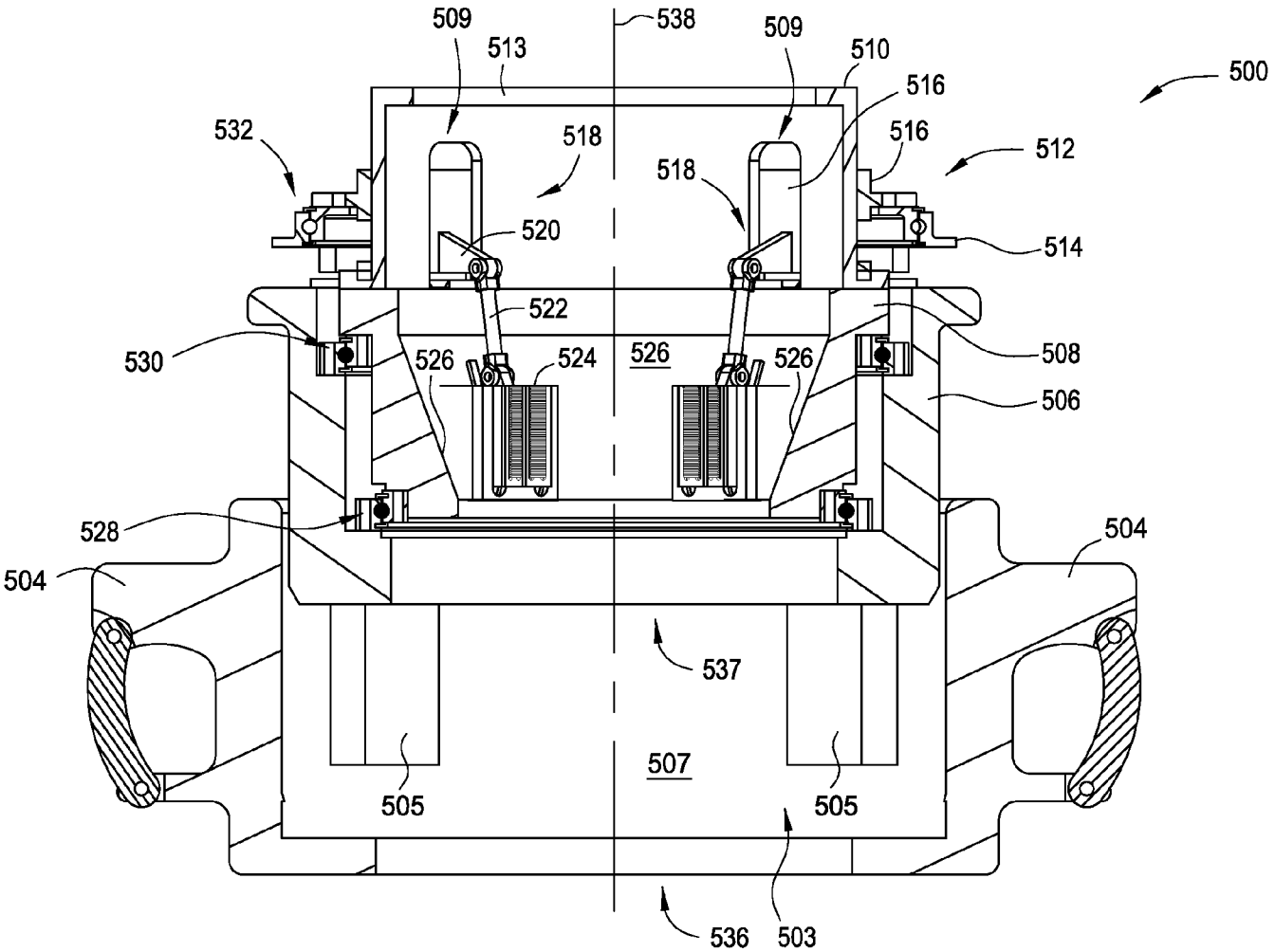
FIG. 5C is a second cross-sectional view of the swivel elevator of FIG. 4A as arranged in FIG. 5A.

Referring primarily to FIGS. 4B and 4C, in various embodiments, the inner body 508 can be nested within the outer body 506 and is supported by bearings 528 and 530 arranged between the outer body 506 and the inner body 508. The bearings 528 and 530 enable the inner body 508 to rotate about the axis of rotation 538 relative to the outer body 506. The inner body 508 can move with the outer body 506 between the extended position (shown in FIGS. 5B and 5C) and the retracted position (shown in FIGS. 4B and 4C) when actuators 534 are actuated. The outer body 506 and the inner body 508 can define an aperture 537 in communication with the aperture 536 in the housing 502 such that a tubular such as a casing inserted through the aperture 536 in the housing 502 can also be inserted through the aperture 537 in the outer body 506 and inner body 508.

Figure 6A:
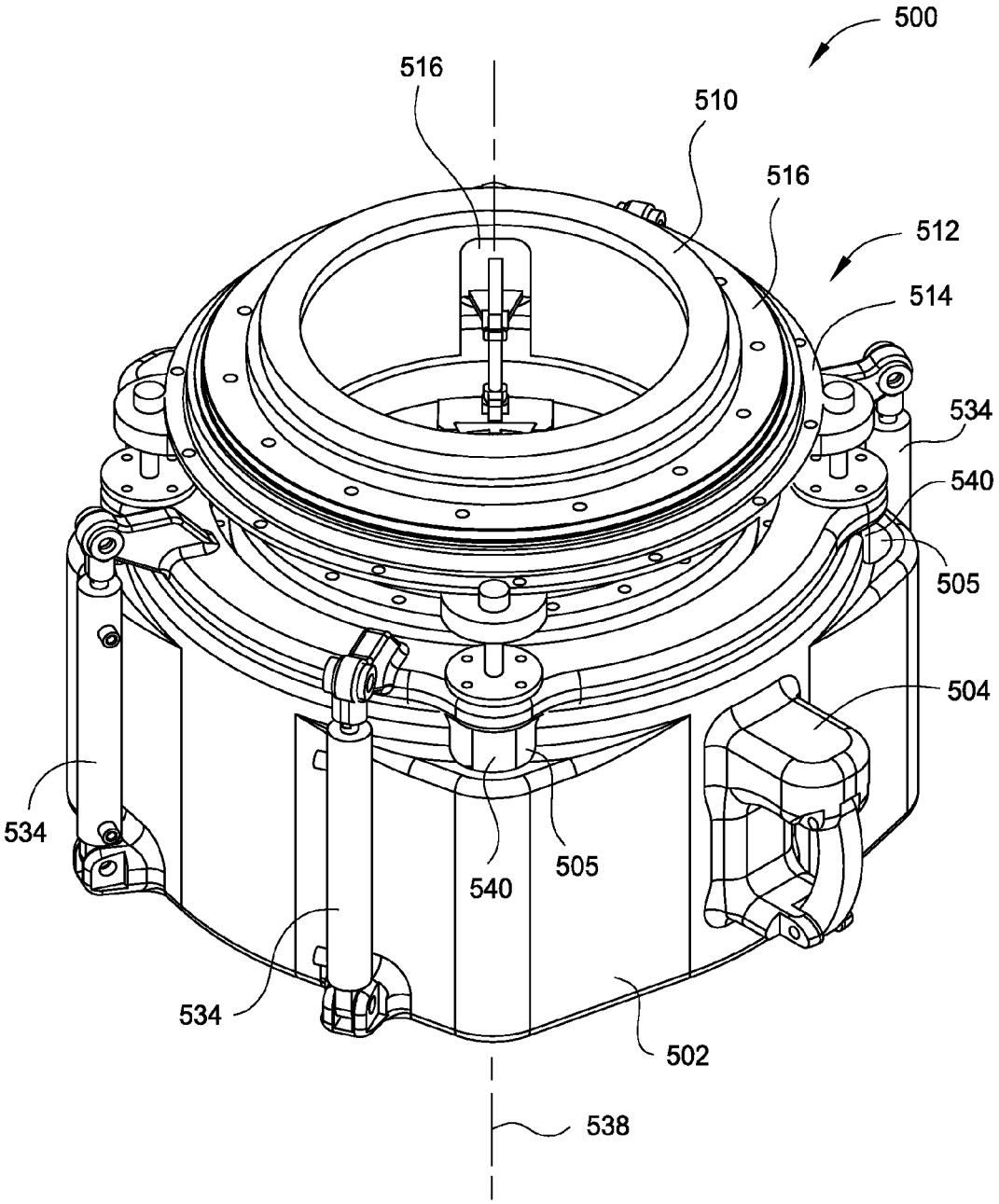
FIG. 6A is a perspective view of the swivel elevator of FIG. 4A arranged with the compensation system in the lowered position and the leveling ring in a raised position.
Figure 6B:
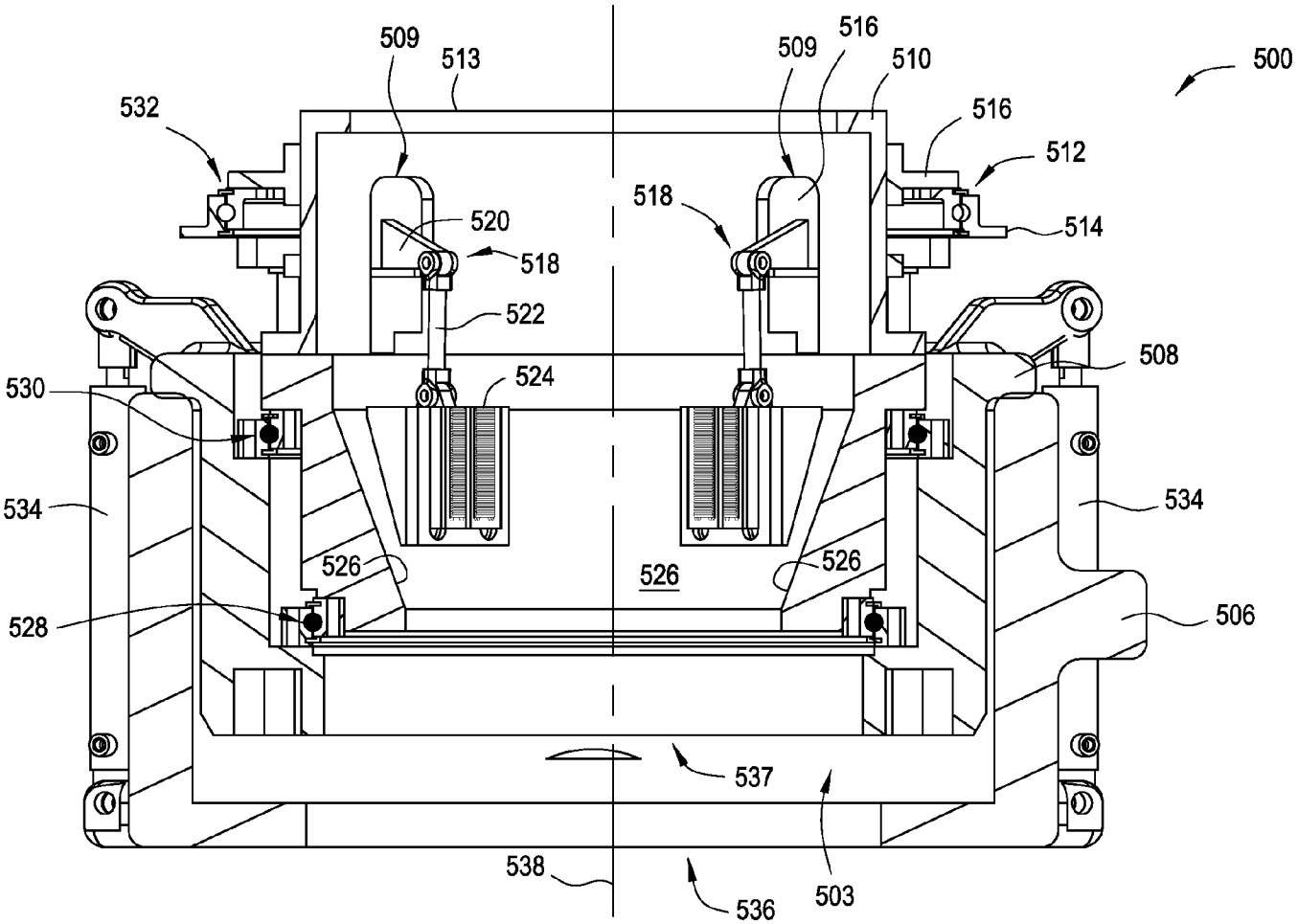
FIG. 6B is a first cross-sectional view of the swivel elevator of FIG. 4A as arranged in FIG. 6A.
Figure 6C:
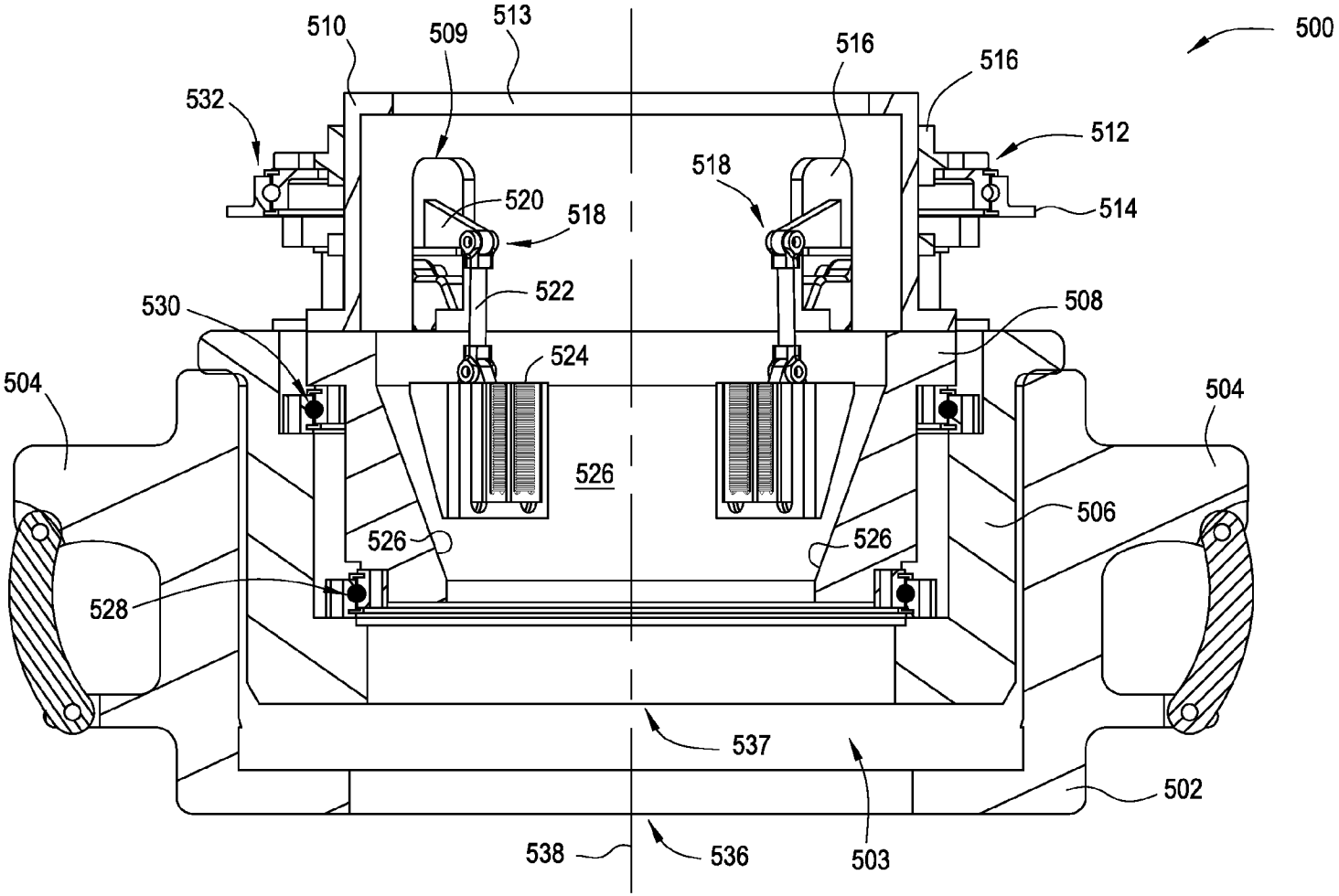
FIG. 6C is a second cross-sectional view of the swivel elevator of FIG. 4A as arranged in FIG. 6A.

In various embodiments, the inner body 508 can support gripping elements (e.g., slips 518) adapted to grip a casing or tubular inserted through the apertures 536 and 537. In one example, each slip 518 can include a pad 524 that can slide along a sloped inner wall 526 of the inner body 508. The sloped inner wall 526 defines a larger diameter at a top end and a smaller diameter at a bottom end. As the pads 524 slide along the sloped inner wall 526 from the top end to the bottom end, the pads 524 move radially inward and can clamp onto a casing or tubular inserted through the apertures 536 and 537. In one example, the pads 524 may include teeth for gripping the tubular. The slips 518 can be connected to and moved by an optional leveling ring 512, which is axially movable along the axis of rotation 538. The leveling ring 512 may be used to move the slips 518 simultaneously. FIGS. 4A-4C and 5A-5C illustrate the leveling ring 512 in a lowered position relative to the inner body 508. FIGS. 6A-6C illustrate the leveling ring 512 in a raised position relative to the inner body 508.

The leveling ring 512 can include an outer portion 514 and an inner portion 516. The outer portion 514 of the leveling ring 512 can be coupled to the outer body 506 by actuators 540 (e.g., hydraulic or pneumatic pistons). When the actuators 540 are in their retracted positions (shown in FIGS. 4A-4C and 5A-5C), the leveling ring 512 can be in its lowered position relative to the outer body 506. When the actuators 540 are in their extended positions (shown in FIGS. 6A-6C), the leveling ring can be in its raised position relative to the outer body 506. The actuators 540 can prevent the outer portion 514 of the leveling ring 512 from rotating about the axis of rotation 538 relative to the outer body 506. A bearing 532 can be arranged between the outer portion 514 and the inner portion 516 of the leveling ring 512 to enable the inner portion 516 to rotate about the axis of rotation 538 relative to the outer portion 516. In another embodiment, the leveling ring 512 can be attached to the inner body 508 using actuators. In this arrangement, the actuators and the leveling 512 would be rotatable with the inner body 508.

As described above, the slips 518 can be connected to the leveling ring 512 such that the pads 524 of the slips 518 can be moved along the sloped inner wall 526 of the inner body 508. The inner portion 516 of the leveling ring 512 can include a plurality of flanges 520 that can extend radially inward. For each slip 518, a bar linkage 522 can be connected at a first end to the pad 524 and at a second end to one of the flanges 520. In various embodiments, the bar linkage 522 can be connected to the flanges 520 and the pads 524 with bearings, bushings, pins, or the like, to enable each bar linkage 522 to pivot relative to its respective flange 520 and pad 524 as the pads 524 move along the sloped inner wall 526 of the inner body 508.

Figure 9A:
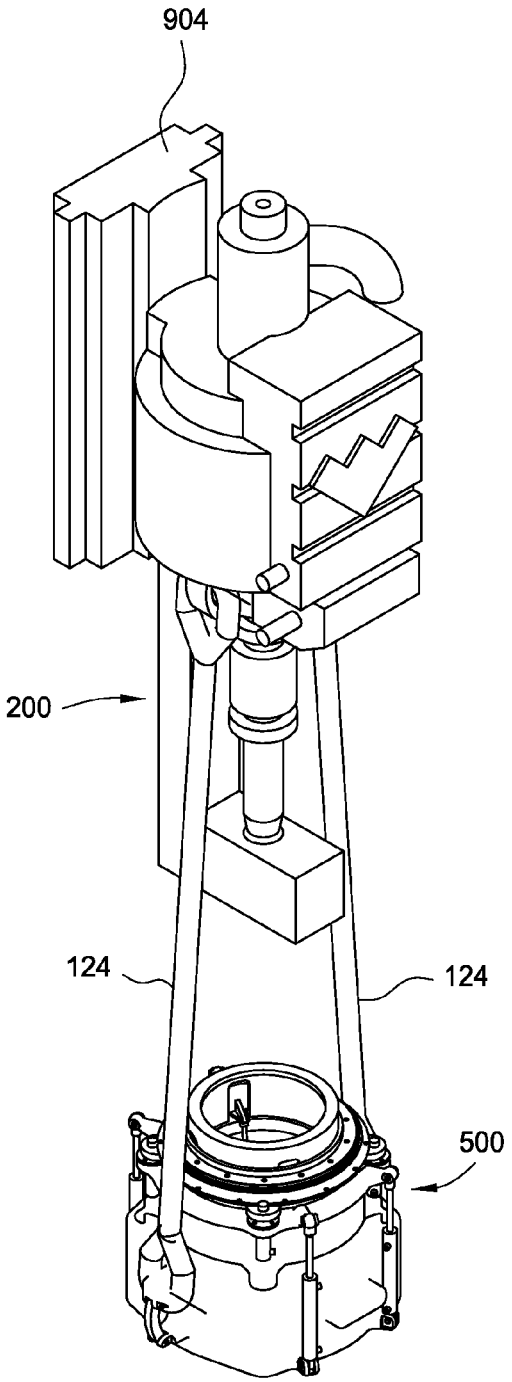
FIG. 9A is a perspective view of a top drive with an embodiment of an elevator with a compensation system arranged relative to the top drive.
Figure 9B:
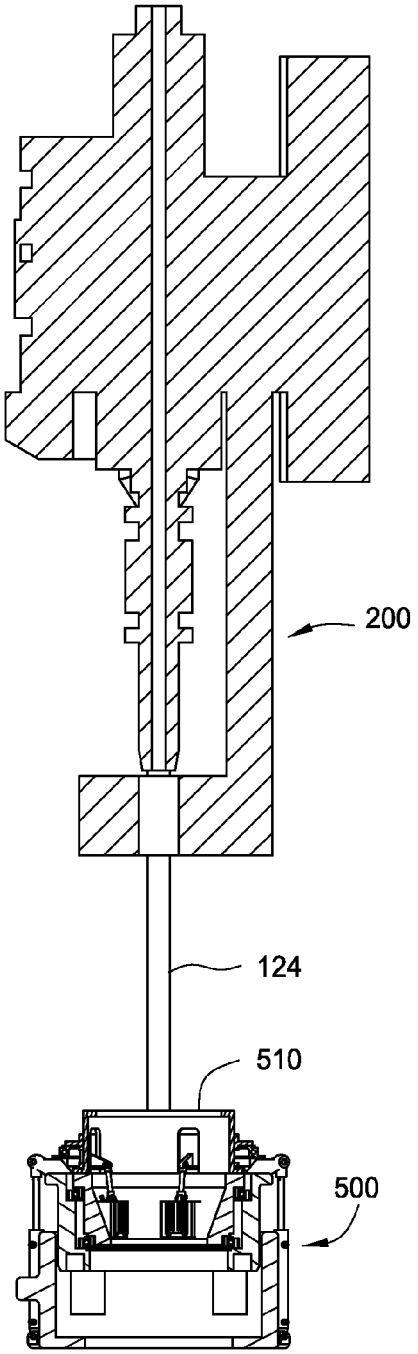
FIG. 9B is a side view of the top drive and the elevator of FIG. 9A and further illustrating a shaft connecting the top drive to a cap of the elevator.
Figure 9C:
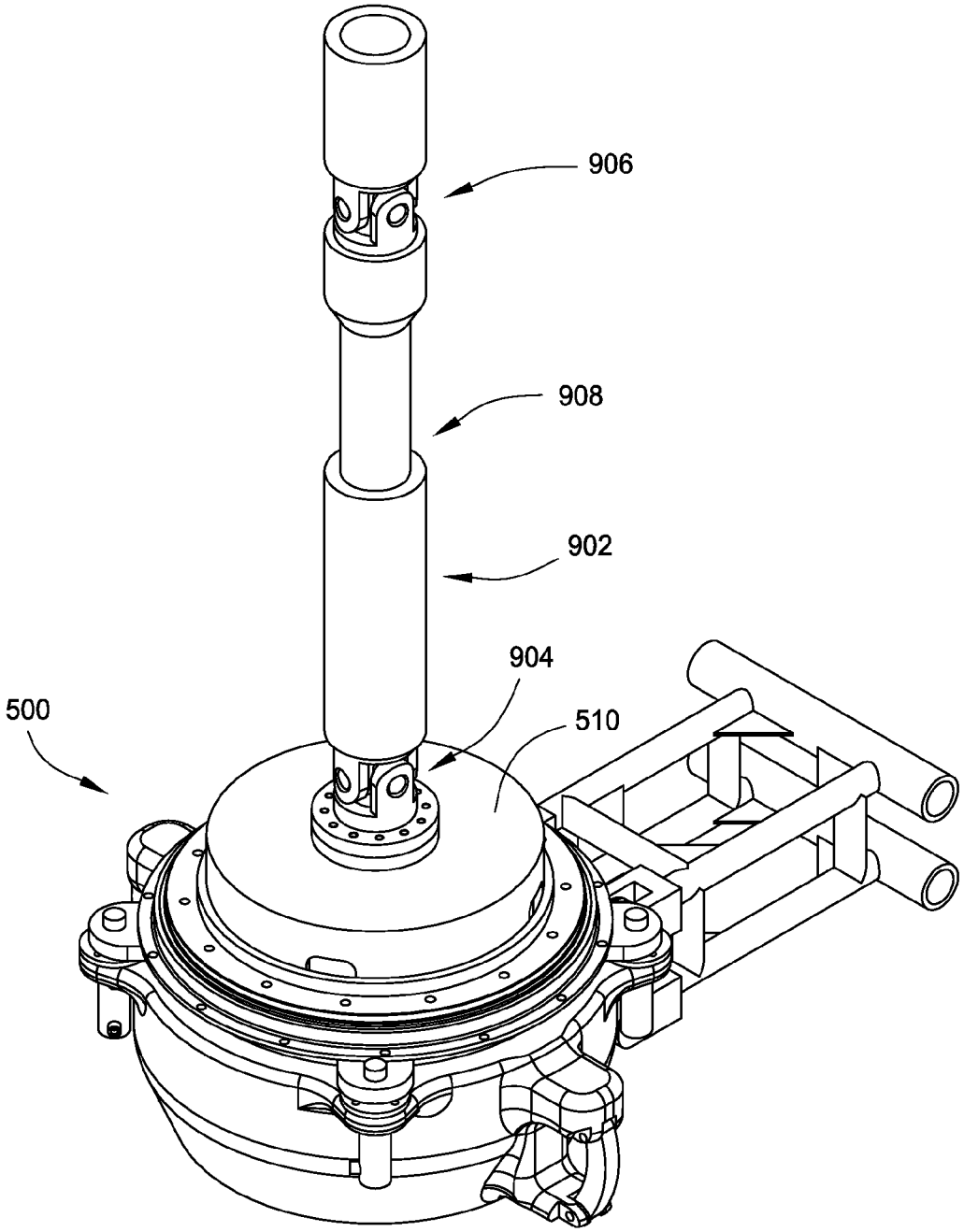
FIG. 9C is a perspective view of the elevator and shaft of FIG. 9B.

In certain embodiments, a cap 510 can be arranged on top of and connected to the inner body 508 such that the cap 510 rotates with the inner body 508. The cap 510 can include windows 509 through which the radially-inward extending flanges 520 can pass. The cap 510 can alternatively be closed and include a mounting surface. Referring to FIG. 9C, a shaft 902 can be coupled to the cap 510 and to the top drive 200. The top drive 200 can be rotated to rotate the shaft 902 and the cap 510. The cap 510 in turn can rotate the inner body 508 and the slips 518 such that a tubular gripped by the slips 518 is rotated. The shaft 902 can include one or more joints (e.g., universal joints) 904 and 906 that enable the elevator 500 to pivot relative to the top drive 200. The shaft 902 can also include a slip joint 908 that enables the elevator 500 to move towards or away from the top drive 200.

Figure 2:
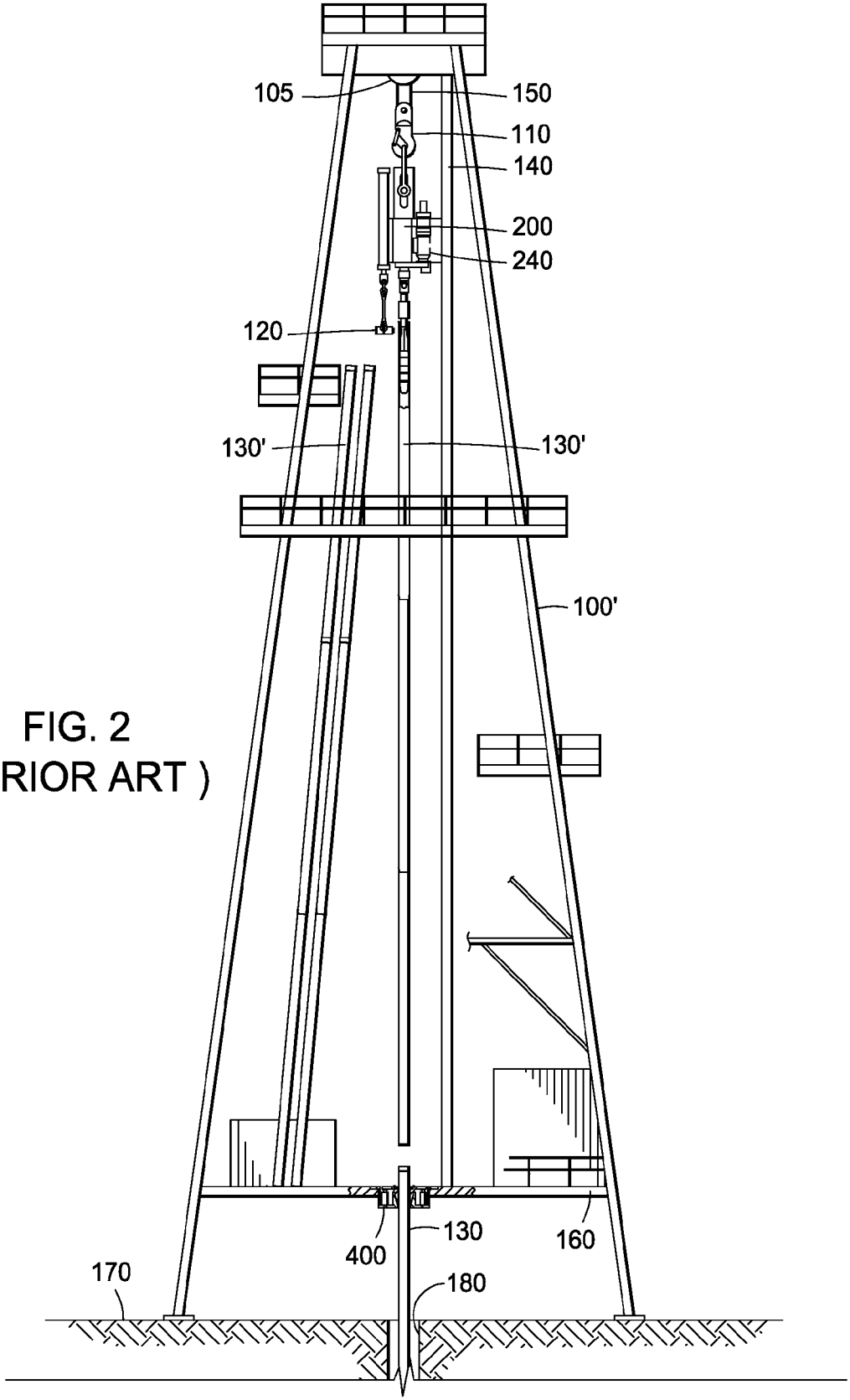
FIG. 2 ( PRIOR ART )

In certain other embodiments, the cap 510 can be omitted (or a top portion 513 of the cap 510 can define an aperture 513). In such embodiments, an internal gripping tool (e.g., gripping tool 301 shown in FIG. 3) of a top drive (e.g., top drive 200 shown in FIGS. 1-3) can engage an internal bore of the tubular being gripped by the slips 518 of the elevator 500. The top drive 200 can directly drive (i.e., spin) the tubular, and the inner body 508 and slips 518 can rotate with the tubular to support the tubular. In embodiments in which a gripping tool 301 engages the tubular, a fill-up tool of the top drive 200 may be provided to inject drilling mud or the like into the tubular.

Figure 7:
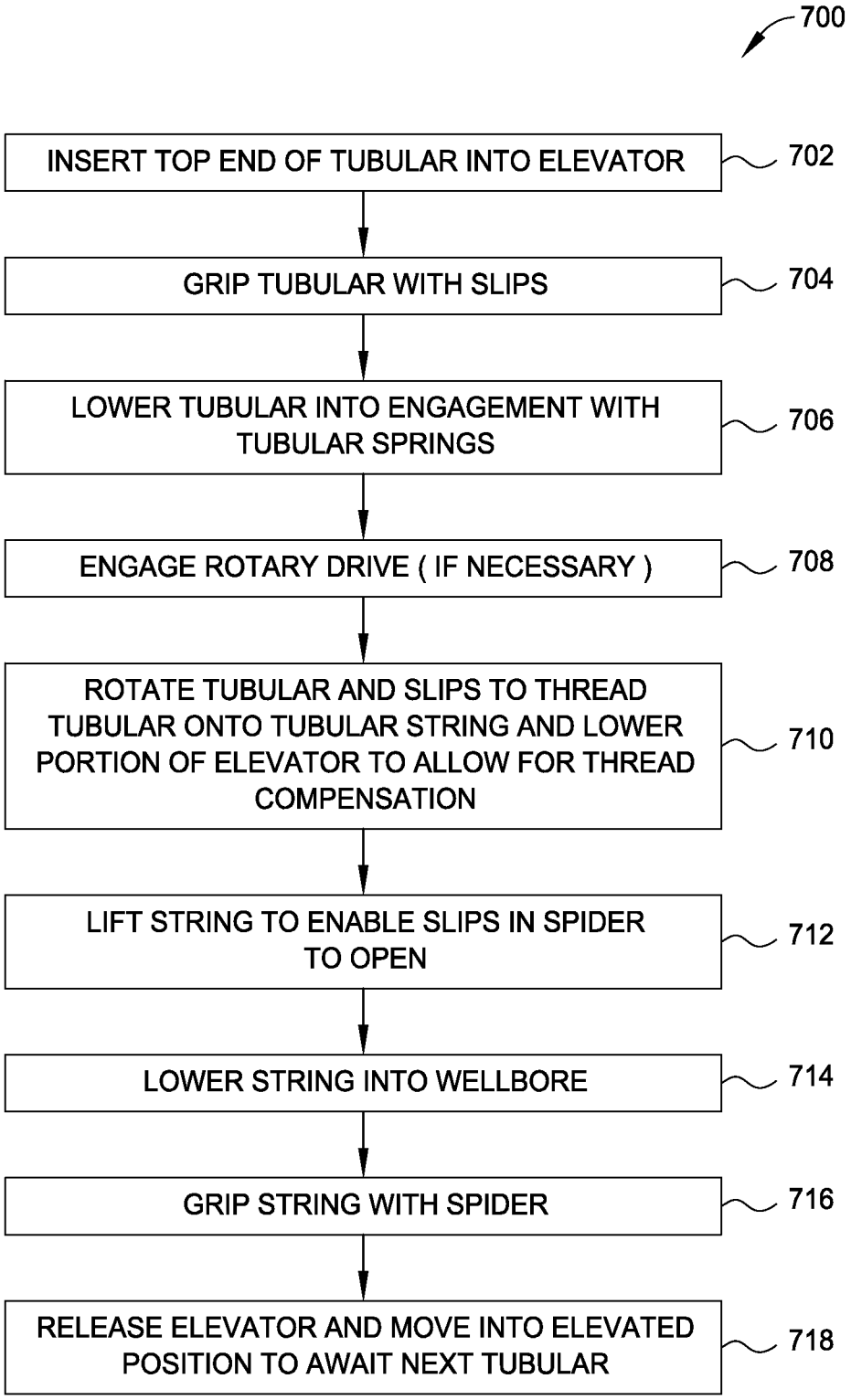
FIG. 7 is a flow chart illustrating use of the swivel elevator of FIG. 4A.

Referring now to FIG. 7, a method 700 of operation of the above-described elevator 500 to assemble a tubular string at a drilling rig (e.g., drilling rig 100) will now be described. At the start (block 702), the elevator 500 is moved relative to a waiting tubular such as a casing section (e.g. tubular sections 130' shown in FIG. 2) such that a top end of the waiting tubular passes through the apertures 536 and 537 of the elevator 500. Next (block 704), the slips 518 are actuated to engage the tubular 130'. In this embodiment, the actuators 540 are actuated from the extended position (shown in FIGS. 6A-6C) to the retracted position (shown in FIGS. 4A-4C and 5A-5C). As described above, retracting the actuators 540 moves the leveling ring 512 to its lowered position, thereby lowering the slips 518 along the sloped inner wall 526 of the inner body 508. As a result, the pads 524 of the slips move radially inward to clamp against the tubular 130'.

After the tubular 130' is clamped by the slips 518, the elevator can be moved to position the tubular 130' over a tubular string (e.g., tubular string 210 shown in FIG. 2) held by a spider (e.g., spider 400) of the drilling rig (block 706). As described above, in various embodiments, the cap 510 of the elevator 500 can be omitted or can include an aperture 513 therethrough. In such embodiments, the method 700 can include a step of operatively coupling the top drive to the tubular 130' (block 708). For example, an internal gripping tool (e.g., gripping tool 301 shown in FIG. 2) can engage an inner wall of the tubular 130'. In another example, the elevator 500 can include a cap 510 connected directly to the top drive 200 or the gripping tool 301 such that the top drive 200 spins the cap 510 that, in turn, spins the inner body 508, slips 518, and the tubular 130'. Furthermore, in various other embodiments, the top drive 200 can be coupled directly to the cap 510. In such embodiments, block 708 of the method 700 can be skipped.

After the tubular 130' is positioned over the tubular string 130, the top drive rotates the tubular 130' to threadedly connect the tubular 130' onto the tubular string 130 by the driveshaft connecting the top drive and the elevator. Alternatively, a tong arranged proximate to the rig floor can grip and rotate the bottom of the tubular 130'. As another alternative, an additional motor drive (e.g., such as the motor drive 968 shown in FIG. 10) can rotate the tubular 130'. In one embodiment, the slips 518 are rotated along with the tubular 130' (block 710).

As described above, as the tubular 130' is spun and threaded on the tubular string 130, the tubular 130' will move downwardly toward the tubular string 130. To compensate for the downward movement of the tubular 130 as it is spun and threaded on to the tubular string 130, actuators 534 are actuated from their extended position to their retracted position (block 710). As a result, the outer body 506, inner body 508, and slips 518 move downwardly with the tubular 130' to keep the force on the threaded joint from building. Control of the actuators 534 is explained in greater detail below.

After the tubular 130' has been threaded onto the tubular string 130, in block 712, the elevator 500 can lift the tubular string 130 to enable the spider to release the tubular string 130. Thereafter, the tubular string 130 (including the newly added tubular 130') is suspended in the wellbore using the elevator 500. Specifically, the tubular string 130 and newly-added tubular 130' are suspended by the slips 518 in the elevator 500. Then, in block 714, the elevator 500 can lower the tubular string 130 into the well bore. Optionally, during the descent, the top drive 200 may rotate the tubular string 130 to spin a drill head at the bottom of the tubular string 130. The drill head can drill at the bottom of the wellbore to increase the depth of the wellbore. As described above, in certain embodiments, the top drive 200 can inject drilling mud or other drilling fluids into the top of tubular held by the elevator 500 to facilitate drilling via a fill up tool. The elevator 500 can continue to lower the tubular string 130 until only a top portion of the newly-added tubular 130' protrudes above the spider. After the tubular string 130 is lowered, in block 716, the spider 400 can re-grip the tubular string 130 such that the tubular string 130 is suspended in the wellbore by the spider 400.

After the spider 400 has re-gripped the tubular string 130, the slips 518 in the elevator can release the tubular string 130 (block 718). In this embodiment, actuators 540 can be actuated from their retracted position (shown in FIGS. 4A-4C and 5A-5C) to their extended position (shown in FIGS. 6A-6C) to move the leveling ring 512 and slips 518 upwards. When the leveling ring 516 moves upwards, the pads 524 of the slips 518 slide upwards along the sloped inner wall 526 of the inner body 508. As a result, the slips 518 move radially outwards away from the tubular string 130. After the slips 518 have released the tubular string 130, the elevator 500 can be removed and moved away from the top end of the tubular string 130 (block 718). The method 700 can then be repeated, starting with block 702, with the next tubular 130' to be installed on the tubular string 130.

Figure 8:
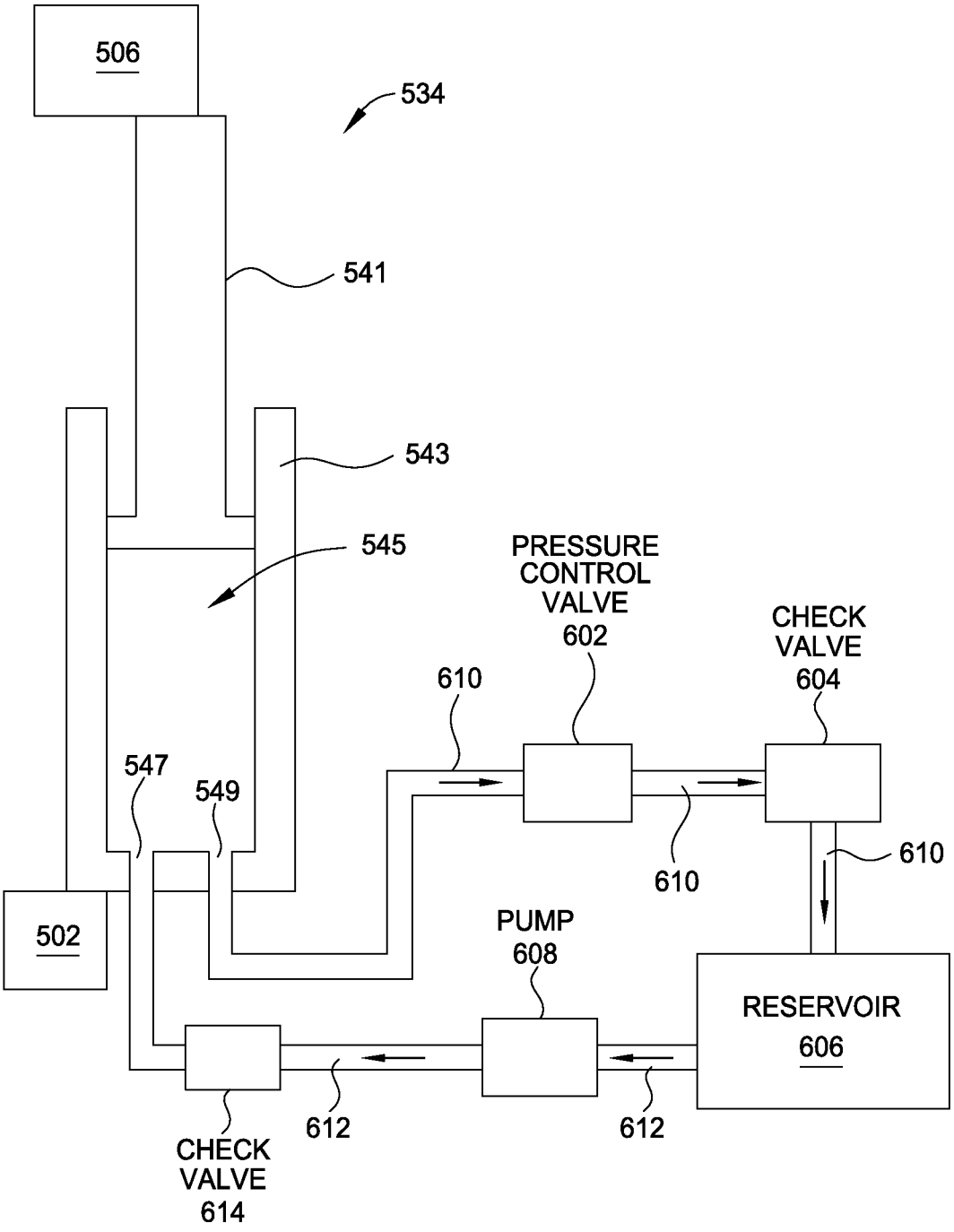
FIG. 8 is a schematic diagram of an embodiment of a hydraulic system for actuating a compensation system between a raised position and a lowered position.

Referring now to FIG. 8, in various embodiments, the actuators 534 that move the outer body 506, inner body 508, and tubular 130 can be hydraulically or pneumatically driven pistons. Each actuator 534 can include a cylinder 543 and a piston 541 that can slide within the cylinder 543. The cylinder 543 can be attached to the housing 502 of the elevator, and the piston 541 can be attached to the outer body 506 of the elevator 500, for example. The cylinder 543 and piston 541 define a volume 545 that can be filled with a hydraulic fluid or a gas (e.g., air or nitrogen). The cylinder 543 can include a first port 547 and a second port 549 that are in communication with a reservoir 606 (e.g., filled with hydraulic fluid or gas). The fluid or gas exits the reservoir 606 through a supply line 612 to a pump 608 that can pressurize of the fluid or gas. Optionally, the supply line 612 can include a check valve 614 after the pump 608 that prevents the pressurized fluid or gas from flowing backwards toward the pump 608. The fluid or gas then continues through the supply line 612 to the first port 547 in the cylinder. The pressurized fluid or gas fills the volume 545 and exerts a force against the piston 541, pushing the piston 541 towards the extended position of the actuator 534 (shown in FIGS. 5A-5C).

The second port 549 of the cylinder 543 can be connected to a return line 610 that passes through a pressure control valve 602 and, optionally, a check valve 604. As explained in more detail below, in various embodiments, the pressure control valve 602 can be set to open (releasing fluid or gas from the volume 545 of the actuator 534) when the fluid or gas pressure in the volume 545 exceeds a threshold pressure corresponding to slightly more than a weight of the suspended portions of the elevator 500 and tubulars 130' suspended from the elevator 500. In various other embodiments, the pressure control valve 602 can be set to open when the fluid or gas pressure in the volume 545 exceeds a threshold pressure corresponding to slightly less than the weight of the suspended portions of the elevator 500 and the tubulars 130'. When the fluid or gas pressure in the volume 545 exceeds the threshold pressure, the pressure control valve 602 opens to allow the fluid or gas to recirculate to the reservoir 606.

Still referring to FIG. 8, all portions of the elevator 500, except for the housing, can be suspended from the actuators 534. The weight of the outer body 506, inner body 508, cap 510, leveling ring 512, slips 518, and bearings 528, 530, and 532 exert a downward force on the piston 541 of each actuator 534. This downward force is transmitted to and countered by the pressure of the fluid or gas in the volume 545 between the piston 541 and the cylinder 543. In addition, when the elevator 500 is gripping a tubular (e.g., tubular 130'), a downward force caused by the weight of the tubular is also transmitted to the piston 541 and is also countered by the pressure of the fluid or gas in the volume 545. As the downward force on the piston increases, the pressure of the fluid or gas in the volume 545 increases. Thus, as the tubular 130' is spun and threaded onto a tubular string 130 in the wellbore, the downward force caused by the tubular 130' moving toward the tubular string 130 is also transmitted through the piston 541 to the fluid or gas in the volume 545. Thus, as the tubular 130' is threaded onto the tubular string 130, the pressure of the fluid or gas in the volume 545 builds. As the pressure in the volume 545 builds, the pressure can exceed the threshold pressure of the control valve 602, opening the valve 602 and enabling some fluid or gas from the volume 545 to escape. As the fluid or gas escapes from the volume 545, the piston 541 can move downwardly, reducing the size of the volume 545. As a result, the portions of the elevator 500 suspended from the actuators 534 also move downwardly, relieving the tensile force building in the threaded joint between the tubular 130' and the tubular string 130. When the pressure in the volume 545 drops below the threshold pressure, the pressure control valve 602 can close again.

In various embodiments, the pressure at which the pressure relief valve 602 opens can be set to a pressure slightly less than needed to counter the weight of the gripped tubular (e.g., tubular 130'). In such embodiments, the check valve 604 can be controllably actuated to allow or prohibit flow of hydraulic fluid to the reservoir 606. When a tubular is gripped by the elevator 500 and lifted, the check valve 604 can be actuated to a closed position such that hydraulic fluid cannot escape the cylinder volume 545 and the piston 541 cannot move downwardly. After the tubular is aligned with the tubular string (e.g., tubular string 130) for threading engagement, the check valve 604 can be opened. The pressure relief valve 602, set for a pressure that does not fully support the weight of the tubular, can then allow some hydraulic fluid to flow from the volume 545 to the reservoir 606. Consequently, the piston 541 and portions of the elevator 500 supported by the piston (e.g., outer body 506) can move downwardly until the threads of the tubular are resting on the mating threads of the tubular string. At this point, the threads of the tubular string are supporting the portion of the weight of the tubular that is not supported by the pistons 534. As the tubular is threaded into engagement with the tubular string, the pistons 541 can continue to move downwardly. This process can continue until the tubular is fully threaded onto the tubular string. Under this method, the top drive (or other mechanism rotating the tubular) is applying less torque than would be needed to overcome friction between the mating threads if the full weight of the tubular were resting on the tubular string.

In various embodiments, the pressure control valve 602 can be adjustable to account for different types of tubulars and casings that may weigh different amounts. In various other embodiments, the actuators 534 can be electrically actuated and computer controlled. For example, the actuators 534 can include electric-motor-driven jack screws that raise and lower the outer body 506, inner body 508, cap 510, and leveling ring 512.

Figure 10:
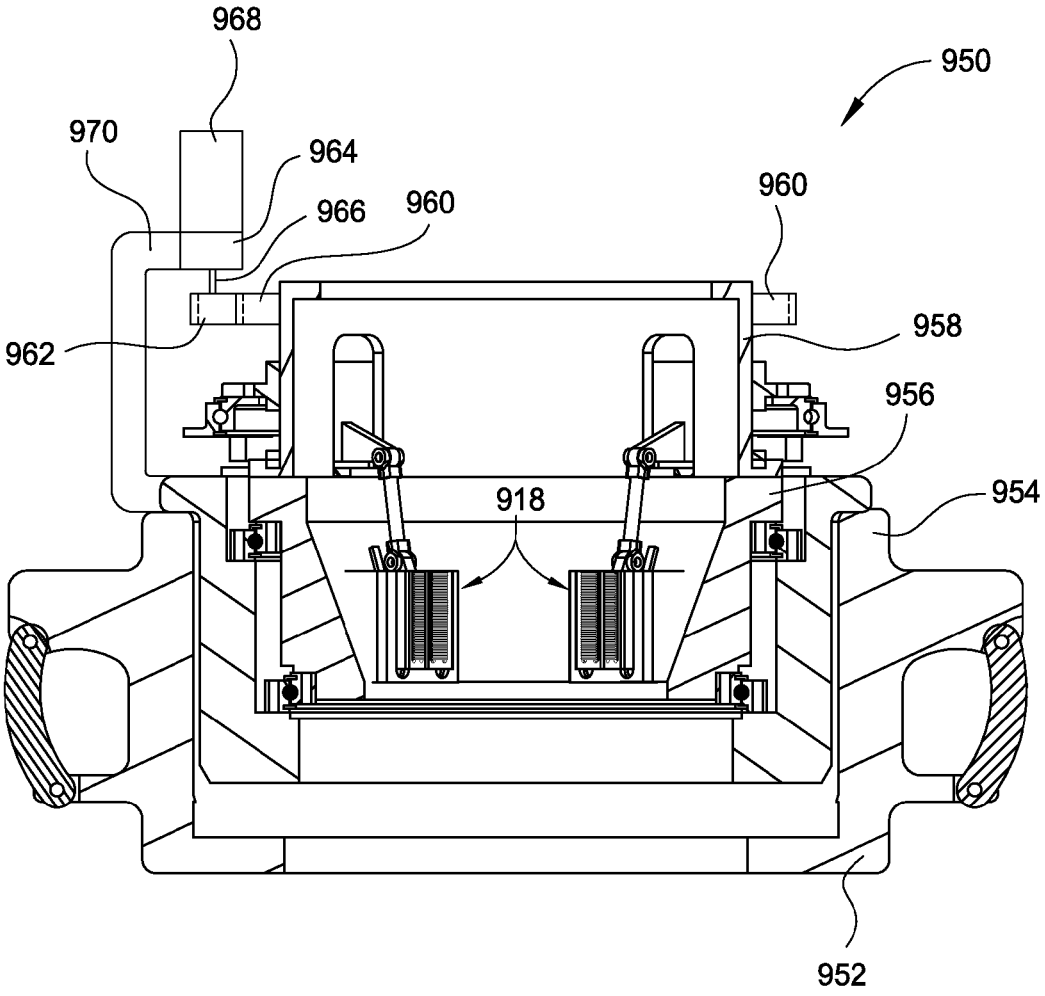
FIG. 10 is a side view of an embodiment of an elevator with an attached electric motor that rotates a portion of the elevator to attach a tubular to a tubular string.

Referring now to FIG. 10, in various embodiments, an elevator 950 can spin a tubular (e.g., tubular 130') without the aid of a top drive. For example, a motor 968 (e.g., a hydraulic motor, a pneumatic motor, or an electric motor) can be mounted to the outer body 954 of the elevator 950. A ring gear 960 can be arranged on the cap 958 or on the inner body 956 of the elevator 950, for example. A pinion gear 962 on an output shaft 966 of the motor 968 can engage the ring gear 960 to spin the cap 958, inner body 956, and slips 918, thereby turning a tubular 130' suspended by the elevator. Optionally, a transmission or gearbox 964 can be disposed between the motor 968 and the output shaft 966. The gearbox 964 can multiply torque output of the motor 968 and also prevent the cap 958 and ring gear 960 from back driving the motor 968. The motor 968 and/or gearbox 964 can be connected to the outer body 954 via a bracket 970. By connecting the motor 968 and/or gearbox 964 to the outer body 954, the motor 968 and/or gearbox 964 can move with the outer body 654, inner body 956, and cap 958 as they move relative to the housing 952.

In one embodiment, a drilling rig elevator for handling a tubular includes a housing having a first aperture therethrough for accommodating the tubular; an outer body having a second aperture therethrough and at least partially disposed in the housing; an inner body having a third aperture therethrough and at least partially disposed in the outer body, wherein the third aperture is coaxial with the first aperture and the second aperture; and a plurality of slips arranged within the third aperture and configured to grip the tubular passing through the first, second, and third apertures.

In one or more of the embodiments described herein, the inner body is configured to axially move with the outer body and to rotate relative to the outer body.

In one or more of the embodiments described herein, the outer body is configured to axially move relative to the housing.

In one or more of the embodiments described herein, the elevator optionally includes a bracket coupled to the housing and configured for attachment to a rail of the drilling rig, wherein the bracket is configured to resist rotation of the housing.

In one or more of the embodiments described herein, the elevator optionally includes at least two bearings arranged between the outer body and the inner body, wherein the at least two bearings enable the inner body to rotate about the axis relative to the outer body.

In one or more of the embodiments described herein, the third aperture defines a sloped inner wall, wherein the plurality of slips are movable along the sloped inner wall between a tubular gripping position and a tubular releasing position.

In one or more of the embodiments described herein, rotation of the inner body and plurality of slips about the axis can spin the tubular into threading engagement with a tubular string, and wherein as the tubular is spun into threading engagement with the tubular string the outer body and inner body move along the axis to compensate for motion of the tubular toward the tubular string.

In one or more of the embodiments described herein, the leveling ring optionally includes an inner portion that rotates about the axis with the inner body and the slips and an outer portion; wherein the elevator further comprises a second plurality of actuators connecting the outer portion of the leveling ring to the outer body, wherein the second plurality of actuators are actuatable between a retracted position and an extended position, wherein moving the actuators from the extended position to the retracted position moves the slips from the first slip position to the second slip position.

In one or more of the embodiments described herein, the elevator optionally includes a bearing arranged between the inner portion and outer portion of the leveling ring, wherein the bearing enables the inner portion to rotate about the axis relative to the outer portion.

In one or more of the embodiments described herein, the elevator optionally includes a first plurality of actuators connecting the housing to the outer body and configured to move the outer body relative to the housing.

In one or more of the embodiments described herein, the elevator optionally includes a cap coupled to the inner body, wherein the cap is configured to be coupled to a top drive of the drill rig, and wherein rotation of the top drive causes the cap, inner body, and slips to rotate and thereby rotate a tubular gripped by the slips.

In one or more of the embodiments described herein, the elevator optionally includes a motor attached to the outer body, wherein the outer body is configured to drive the inner body to rotate about the axis.

While the foregoing is directed to embodiments of the present invention, other and further embodiments of the invention may be devised without departing from the basic scope thereof, and the scope thereof is determined by the claims that follow.

The invention claimed is:

1. An elevator for use with a drilling rig, comprising:
- a housing configured to be coupled to the drilling rig;
- an inner body, wherein at least a portion of the inner body is disposed in the housing and rotates relative to the housing;
- a plurality of slips adapted to move relative to the inner body between a first slip position and a second slip position, wherein the slips grip a tubular when in the first slip position and release the tubular when in the second slip position; and
- a coupling configured to couple the inner body to the housing, wherein the coupling enables axial movement of the inner body relative to the housing as the tubular gripped by the slips is threaded onto a tubular string.

2. The elevator of claim 1, wherein the coupling comprises a plurality of pistons.

3. The elevator of claim 2, wherein the plurality of pistons are hydraulic pistons, wherein each piston comprises a piston cavity in communication with a pressure relief valve, and wherein the pressure relief valve enables hydraulic fluid from the piston cavities to flow out of the piston cavities as the inner body moves relative to the housing along the axis.

4. The elevator of claim 1, further comprising a cap rotatable with the inner body, and wherein the cap comprises a coupling connectable to a top drive of the drilling rig.

5. The elevator of claim 4, wherein the cap defines at least one aperture.

6. The elevator of claim 1, further comprising a leveling ring configured to move relative to the inner body between a first ring position and a second ring position along the axis of rotation, wherein the leveling ring is coupled to the plurality of slips, and wherein movement of the leveling ring from the first ring position to the second ring position causes the slips to move from the first slip position to the second slip position.

7. The elevator of claim 6, wherein the leveling ring comprises:
- an inner portion and an outer portion, wherein the inner portion rotates relative to the outer portion; and
- a bearing arranged between the inner portion and the outer portion of the leveling ring to enable the inner portion to rotate relative to the outer portion.

8. The elevator of claim 7, further comprising an actuator arranged between the housing and the outer portion of the leveling ring, wherein the actuator is adapted to move the leveling ring from the first ring position to the second ring position.

9. The elevator of claim 1, further comprising an outer body disposed between the inner body and the housing.

10. The elevator of claim 9, wherein the inner body is rotatable relative to the outer body.

11. The elevator of claim 9, wherein the outer body is axially movable relative to the housing.

12. The elevator of claim 11, wherein the inner body is rotatable relative to the outer body.

13. The elevator of claim 1, wherein the housing defines an axis of rotation, wherein the inner body is at least partially disposed within the housing and rotates about the axis of rotation relative to the housing, and wherein the coupling enables movement of the inner body relative to the housing along the axis of rotation as the tubular is gripped by the slips is threaded onto a tubular string.

14. A drilling rig elevator for handling a tubular, comprising:
- a housing having a first aperture therethrough for accommodating the tubular;
- an outer body having a second aperture therethrough and at least partially disposed in the housing;
- an inner body having a third aperture therethrough and at least partially disposed in the outer body, wherein the third aperture is coaxial with the first aperture and the second aperture;
- a plurality of slips arranged within the third aperture and configured to grip the tubular passing through the first, second, and third apertures; and
- wherein axial movement of the outer body relative to the housing is independent of actuation of the plurality of slips.

15. The elevator of claim 14, wherein the inner body is configured to axially move with the outer body and to rotate relative to the outer body.

16. The elevator of claim 14, further comprising at least two bearings arranged between the outer body and the inner body, wherein the at least two bearings enable the inner body to rotate about the axis relative to the outer body.

17. The elevator of claim 14, wherein the third aperture defines a sloped inner wall, wherein the plurality of slips are movable along the sloped inner wall between a tubular gripping position and a tubular releasing position.

18. The elevator of claim 14, wherein rotation of the inner body and plurality of slips about a central axis can spin the tubular into threading engagement with a tubular string, and wherein as the tubular is spun into threading engagement with the tubular string the outer body and inner body move axially along the central axis to compensate for motion of the tubular toward the tubular string.

19. The elevator of claim 18, further comprising a leveling ring having:
- an inner portion that rotates about the axis with the inner body and the slips and an outer portion;
- wherein the elevator further comprises a second plurality of actuators connecting the outer portion of the leveling ring to the outer body, wherein the second plurality of actuators are actuatable between a retracted position and an extended position, wherein moving the actuators from the extended position to the retracted position moves the slips from the first slip position to the second slip position.

20. The elevator of claim 14, further comprising a motor attached to the outer body, wherein the outer body is configured to drive the inner body to rotate about a central axis.

21. The elevator of claim 14, wherein the inner body is configured to axially move with the outer body and to rotate relative to the outer body.

22. The elevator of claim 21, wherein the third aperture defines a sloped inner wall, wherein the plurality of slips are movable along the sloped inner wall between a tubular gripping position and a tubular releasing position.

23. The elevator of claim 22, further comprising at least two bearings arranged between the outer body and the inner body, wherein the at least two bearings enable the inner body to rotate about the axis relative to the outer body.

24. The elevator of claim 14, wherein the plurality of slips are arranged within the second aperture of the outer body.

25. The elevator of claim 14, wherein the plurality of slips are movable relative to the inner body.

26. A method for adding a tubular to a tubular string, the method comprising:

positioning an elevator over an upper portion of a tubular, the elevator having an inner body and a housing;

activating slips disposed in the elevator to grip the upper portion of the tubular;

positioning the elevator and the tubular over the tubular string held by a spider;

rotating the inner body and the tubular relative to the housing to threadedly attach the tubular to the tubular string and simultaneously moving the slips and the inner body axially downward relative to the housing;

releasing the tubular string from the spider;

lowering the elevator, the tubular string, and the tubular;

re-gripping the tubular string near the upper portion of the tubular using the spider; and deactivating the slips to release the tubular.

27. The method of claim 26, wherein the elevator further includes an outer body, and the inner body is rotated relative to the outer body and the housing.

28. The method of claim 26, wherein the elevator further includes an outer body, and the inner body and the outer body are moved axially relative to the housing.

29. An elevator for use with a drilling rig, comprising:

a housing configured to be coupled to the drilling rig;

an inner body, wherein at least a portion of the inner body rotates relative to the housing;

an outer body disposed between the inner body and the housing;

a plurality of slips adapted to move relative to the inner body between a first slip position and a second slip position, wherein the slips grip a tubular when in the first slip position and release the tubular when in the second slip position; and a coupling configured to couple the outer body to the housing, wherein the coupling enables axial movement of the outer body and the inner body relative to the housing as the tubular gripped by the slips is threaded onto a tubular string.

30. The elevator of claim 29, wherein the inner body is rotatable relative to the outer body.

31. The elevator of claim 29, wherein the outer body is axially movable relative to the housing.

32. The elevator of claim 31, wherein the inner body is rotatable relative to the outer body.

* * * * *